United States Patent [19]

Munoz

[11] 3,959,643

[45] May 25, 1976

[54] ANTIBLINDING HEADLAMP FOR VEHICLES

[76] Inventor: Manuel Mariscal Munoz, Waldstrasse 4, 609 Russelsheim, Germany

[22] Filed: July 30, 1974

[21] Appl. No.: 493,736

[30] Foreign Application Priority Data

Aug. 7, 1973 Spain ..... 193930[U]

[52] U.S. Cl. ..... 240/41.35 R; 240/41.3; 240/41.35 F; 240/103 R

[51] Int. Cl.[2] ..... F21V 7/00

[58] Field of Search ..... 240/41.35 R, 41.35 F, 240/41.3, 41.37, 41.4, 103 R

[56] References Cited

UNITED STATES PATENTS

| | | | |
|---|---|---|---|
| 1,747,283 | 2/1930 | Bean | 240/41.35 R |
| 1,788,934 | 1/1931 | Wood | 240/41.37 |
| 1,793,663 | 2/1931 | Wood | 240/41.37 |
| 3,363,093 | 1/1968 | Schmitt | 240/103 R |
| 3,829,677 | 8/1974 | Delano | 240/41.35 R |

*Primary Examiner*—R. L. Moses
*Attorney, Agent, or Firm*—Wenderoth, Lind & Ponack

[57] ABSTRACT

An antiblinding headlamp for vehicles comprises two reflecting surfaces joined to each other, a straight filament arranged transversally in a horizontal position and a converging lens output glass. The upper reflecting surface is a semi-parabola formed by displacing a parabola along a straight line perpendicular to the plane of the parabola and whose surface is cut by three planes which produce, as a projection on the focal plane, an isosceles trapeze. A similar construction is used for the lower reflecting surface, from a semi-parabola having parabolic values differing from the former, with its corresponding focal axis in an advanced position with respect to the focal axis of the upper reflecting surface, while the side portions of the headlamp are flat reflecting surfaces.

2 Claims, 13 Drawing Figures

ANTIBLINDING HEADLAMP FOR VEHICLES

BACKGROUND AND SUMMARY OF THE INVENTION

The object of the present invention is to provide a headlamp for vehicles by means of which the blinding or glaring phenomenon is eliminated, or is at least reduced to a large extent. To achieve such antiblinding effect, the headlamp of the invention comprises two reflecting surfaces which are joined to each other, between which a short straight filament is horizontally and parallely placed with respect to the main reflecting surfaces. The headlamp is completed by a converging lens output glass.

The two reflecting surfaces are semi-parabolas formed by displacing a parabola along a straight line. Such parabolas, which give rise to both the upper and lower reflecting surfaces forming the headlamp assembly, have different parabolic values.

The side parts of the headlamp are flat reflecting surfaces.

It should be pointed out that the upper part of the reflector, as well as the lower part thereof, when formed by parabolas which differ from each other, will give rise to the fact that the focal axes of such parabolas will not coincide, the axis of the lower part of the reflector being in an advanced position with respect to the focal axis of the upper part of the reflector. A lamp is connected to this structure, which lamp is cylindrical in shape and is placed parallely with respect to the headlamp, so that the filament of the lamp will be placed along the focal axis of the upper reflector.

The output glass, which all headlamps include, is in the case of a headlamp made according to the invention, a converging lens whose task is to corradiate the rays dispersed from the reflector and the filament, thus causing the rays to be deviated in a suitable manner so that the light beam, which emerges from such glass, is formed by approximately parallel rays.

With the structure which has just been explained, the light of the headlamps of a vehicle can be projected with a defined separation between a zone situated above a horizontal plane corresponding to the height of the headlamp, and an illuminated zone which will be precisely below such plane.

The upper reflector is a surface which emits light having a large divergence in a horizontal direction (just as in the case of the lower reflector) and a small divergence in a vertical direction, smaller than that of the lower reflector. The present invention is primarily concerned with vertical divergence.

Taking this divergence into account and supposing that the focal plane of the headlamp is horizontal (the plane which embraces the two focal axes, the filament and the vertex), then the luminous rays which emerge from the upper reflector are ascending, and they are more ascending, as they approach the edge i.e. as they are reflected more towards the upper end.

To prevent the luminous rays which emerge from the upper reflector from ascending, such reflector should be turned until its more ascending rays are situated in a horizontal position. The mode of carrying this out will be described subsequently. However, it is now necessary to clarify certain aspects of the invention which are also related to the turning of the upper reflector.

The first aspect refers to a manufacturing characteristic of the headlamp, according to which the illuminating zones of the upper reflector and those of the lower reflector are completely independent i.e. there is at no time any intersection of their rays. Consequently, this causes a weakening in the centre of the complete illuminating beam, precisely in the zone which separates the two illuminating zones of the two reflectors, due to the following reasons:

a. Tapering of the reflector in its assembly which is at its maximum in this zone. Thus, a reduction in the reflection capacity is produced.
b. Presence of the bulb, with the corresponding appearance of reflections in the glass and distortion produced thereby.
c. Presence of the opaque covering, with the corresponding shade production.

The second aspect is directly related to the secondary reflection which is produced in the interior of the headlamp, primarily due to the reflection of the light on the inner surface of the outlet glass. To prevent this reflection, which is a highly important factor in the blinding or glaring phenomenon and which makes the reflecting surfaces shine, there should be arranged in the interior of the headlamp a flat plate, both surfaces of which are covered with a non-reflecting substance or a light absorbing substance. This plate extends from one side of the headlamp to the other and from the proximities of the lens, until it touches the glass of the lamp. It will, at the same time, serve as a protecting cover which prevents direct ascending rays from being emitted.

With these two clarifications in mind, the manner in which the upper reflector should be turned so that the more ascending rays emerging therefrom are finally in a horizontal position and the illuminating zones of the upper and lower reflectors are at the same time joined, thus eliminating the weak zone, will now be described.

The turning of the upper reflector is effected for the filament, as an axis and from there the upper reflector is for the filament, as the axis and from there it is slightly turned until the previously mentioned plate is so positioned that it follows the direction of its rays without intercepting them. Once this has been achieved, the upper reflector is fixed in the assembly of the headlamp. Naturally, with this turning there is a zone which separates the vertices of the upper and lower reflecting surfaces, which before the turning, were coincident. However, due to the smallness of such zone with relation to the assembly of the reflector, its shape is of no great importance, hence it can be an accommodation surface between the two reflectors.

So-called levelling of the maximum ascending rays, which emerge from the upper reflector should be achieved with this turning. This is just as important as is the elimination of the possible weak zone which is formed around the focal plane. However, if the previously described turning is not sufficient to achieve the horizontal positioning of the maximum ascending rays of the upper reflector, a turning of the complete headlamp can be made until the desired positioning is achieved. Logically, this latter will depend on the divergence given to the upper reflector and to the inclination of the opaque-absorbing plate, which factors can be modified as desired.

To establish the position of the absorbing plate within the headlamp, the end thereof near to the lens is situated in the focal plane (horizontal) and the opposite end thereof is parallel to the focal axes and therefore, also horizontal, although slightly raised, with respect to the focal plane of the lower reflector.

When a headlamp assembly, made according to the invention is installed in a conventional automobile, safety or security in night driving is, increased, since blinding of the driver of a vehicle which travels in the opposite direction will be avoided or will be reduced to a great extent. This is another practical advantage of the invention i.e. the; elimination of the device for changing the bright and driving lights which is at present necessary in all vehicles.

Therefore, an object of the present invention is to provide a headlamp for vehicles which projects the light in such a way that there is a darkened zone above a horizontal plane situated at the height of the headlamps of the vehicle. Such zone protects the driver of an on-coming vehicle to which the headlamps of the invention have been adapted, while below such horizontal plane the contemplated headlamp illuminates the ground as well as the objects which are found in the zone below the height of the horizontal plane and the height of the headlamps.

With the headlamps which are presently used, it is not possible to achieve such separation of the illuminating zone and the darkened zone below and above the horizontal plane, respectively. This is due to the fact that the reflecting surface of a conventional headlamp is a revolution paraboloid which projects light, according to a diverging cone, both in a horizontal as well as a vertical direction and which therefore, emits light above the horizontal plane which establishes the position of the headlamps of the vehicle in question.

DETAILED DESCRIPTION OF THE INVENTION

Figure 1:
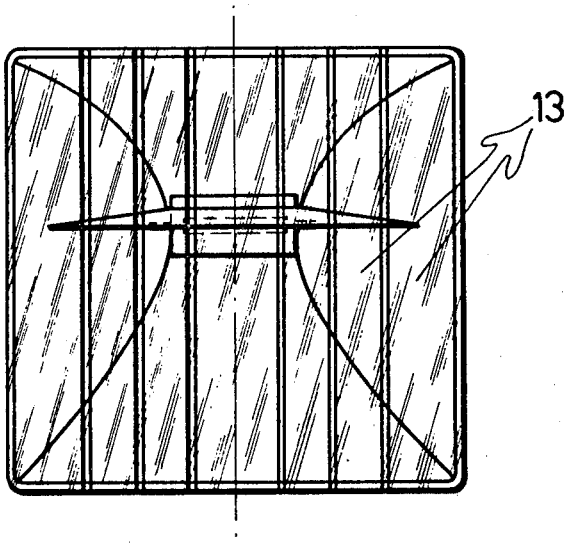
FIG. 1 is a front elevational view of a headlamp according to the invention.
Figure 2:
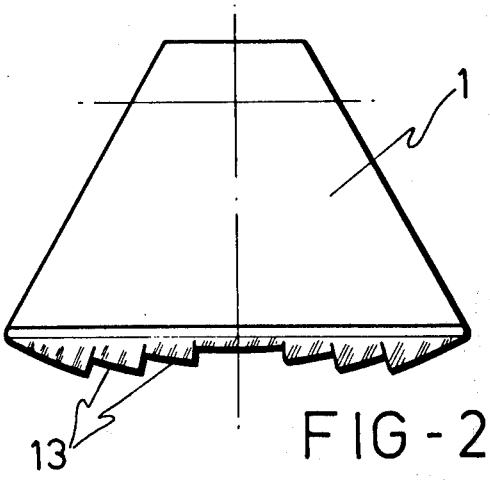
FIG. 2 is an upper plan view thereof.
Figure 3:
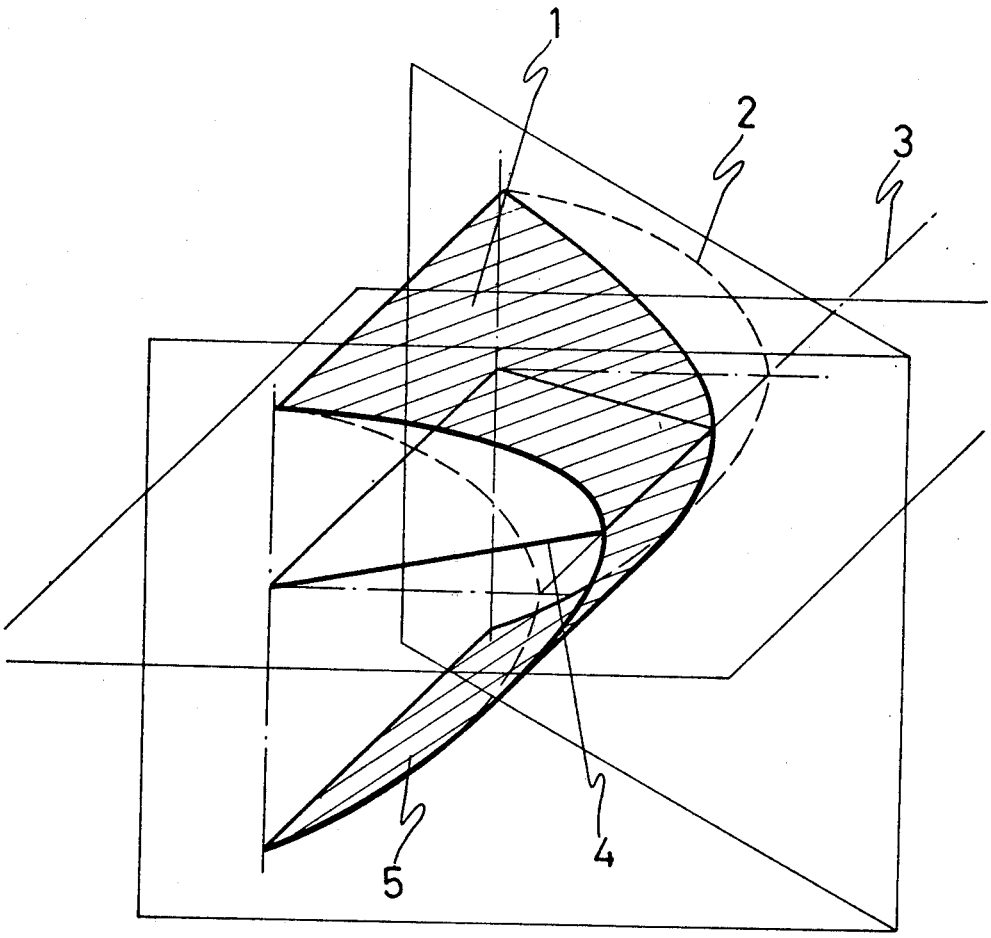
FIG. 3 is a diagram in which the manner in which the reflector of the headlamp is constructed is illustrated.
Figure 4:
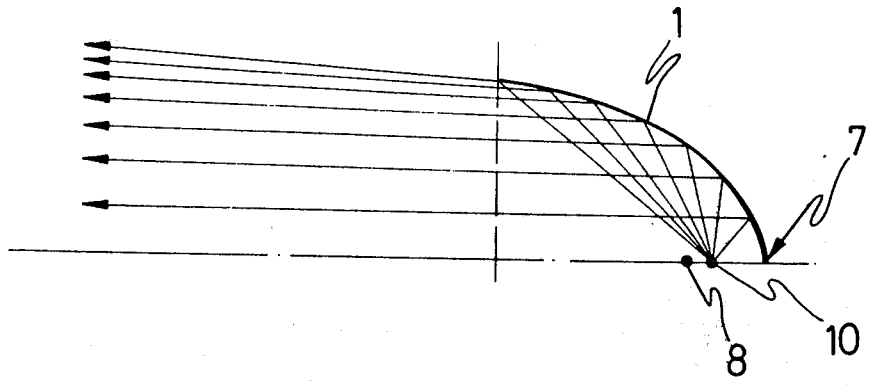
FIG. 4 is a vertical schematic section of a headlamp in which the rays emitted by the upper part of the reflector have been represented.

It can be seen from the mentioned figures that the anti-blinding headlamp of the present invention comprises two reflecting surfaces joined to each other, although they act independently, combined with a straight filament arranged in the interior of a preferably cylindrical bulb which is horizontally and transversally placed, parallel to the focal axes of the two reflecting surfaces, behind a converging lens which forms the outlet glass of the headlamp.

The upper part 1 of the reflector is a bent or curved surface whose shape is a semi-parabola formed by displacing a parabola 2 along a straight line 3 which is tangent to the vertex 7 of the semi-parabola and located in the focal plane of the semi-parabola. The semi-parabola is cut by three planes, in such a way that the bent surface 1, when projected on the focal plane, gives rise to an isosceles trapeze, 4.

Figure 8:
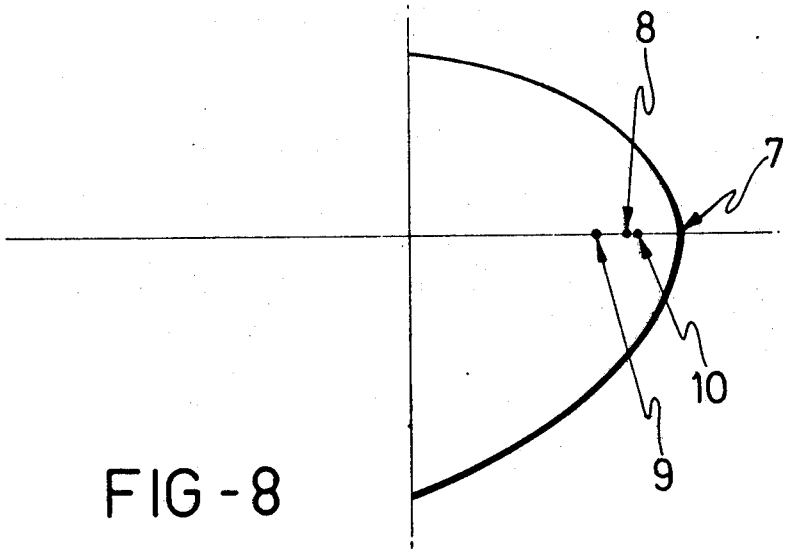
FIG. 8 is a diagram wherein the position occupied in the reflector assembly by the focal axes of the upper and lower parts respectively of such reflector can be seen, as well as the position of the filament of the lighting lamp.
Figure 9:
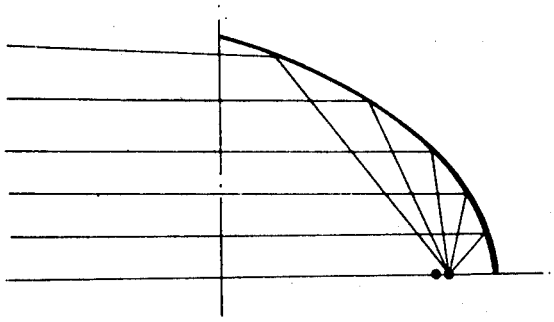
FIG. 9 is a diagram illustrating the upper part of the reflector emitting, in a relatively sparse diverging beam, the luminous rays received from the filament.

The lower part 5 of the reflector is also a bent or curved surface, whose construction is similar to that of upper surface 1, with the only difference being that the two semi-parabolas have different parabolic values, that is, the semi-parabola which forms the lower surface 5 of the reflector is more open than the semi-parabola which forms the upper surface 1 of the reflector. For such reason, and as illustrated in FIG. 8, the focal axes of both reflecting surfaces 1 and 5 are out of phase, so that the focal axis 9 of the lower reflector surface 5 is in a forward position with respect to the focal axis 8 of the upper reflector surface 1.

That is to say, the distance of the focal axis 9 to the vertex 7, wherein both the semi-parabolas forming surfaces 1 and 5 are interconnected, is greater than the distance which separates the focal axis 8 from common vertex 7 of both semi-parabolas.

Figure 5:
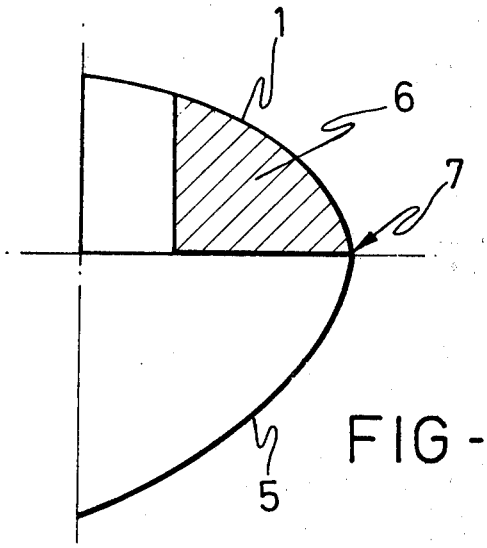
FIG. 5 is a detail view of the side portion of the reflector, for example that corresponding to the right side, wherein an upper zone absorbs the luminous rays, i.e. it does not reflect the rays received thereby, thus preventing an ascending reflection.

The sides of the headlamp, one of which is separately illustrated in FIG. 5, are flat reflecting surfaces having the characteristic that at least one of such sides, for example the right side when dealing with roads where the vehicles operate on the right, may have an opaque or absorbing zone 6 which prevents reflection of the luminous rays which could blind a driver of an on-coming vehicle.

The lamp is preferably formed by a cylinder or tube 11, so that the filament 10 will occupy a position slightly behind the focal axis 8 of the upper semi-parabola so that the upper semi-parabola will emit a beam of approximately parallel luminous rays which are substantially in a horizontal position. The position of the filament 10 produces, in the lower reflector surface 5, a diverging beam which has a larger inclination than that which is produced in the upper reflector surface 1.

The construction of filament 10 is similar to those already known, although it will have a completely straight shape.

Figure 6:
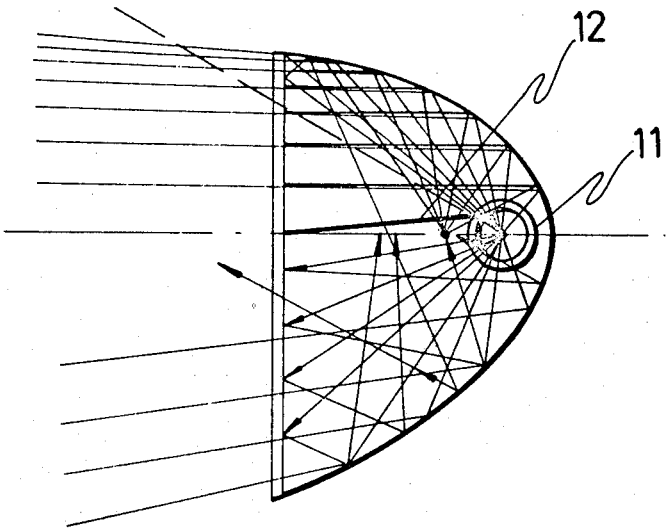
FIG. 6 is a diagram of a headlamp assembly provided with an opaque plate situated in front of the lamp, which will prevent reflection of the light from one reflector towards the other.
Figure 7:
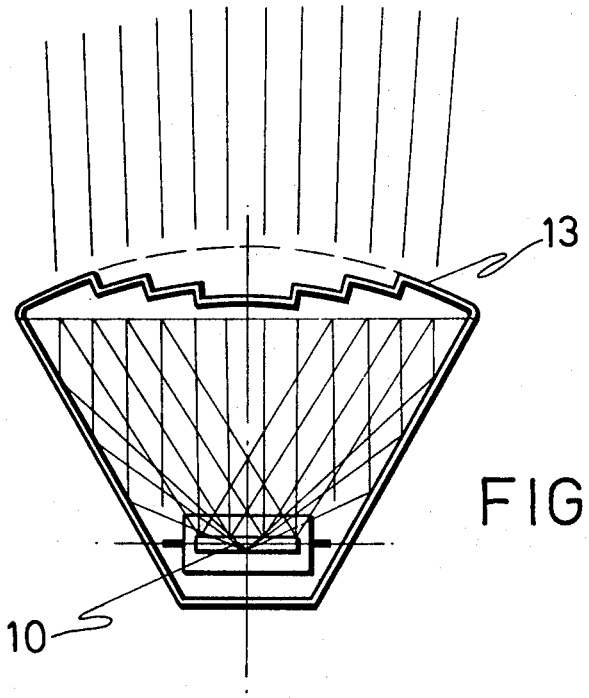
FIG. 7 is a horizontal section of the headlamp in which the special shape of the lens-type glass can be appreciated, by means of which a beam of sparsely dispersed illuminating rays is obtained, i.e. gathered together with respect to the divergence provided thereto by the reflector.

In front of the bulb 11 there will be an opaque zone 12, represented in FIG. 6, by means of which the output of direct ascending rays is prevented. These are the rays which normally cause blinding of the driver of an on-coming vehicle.

Figure 11:
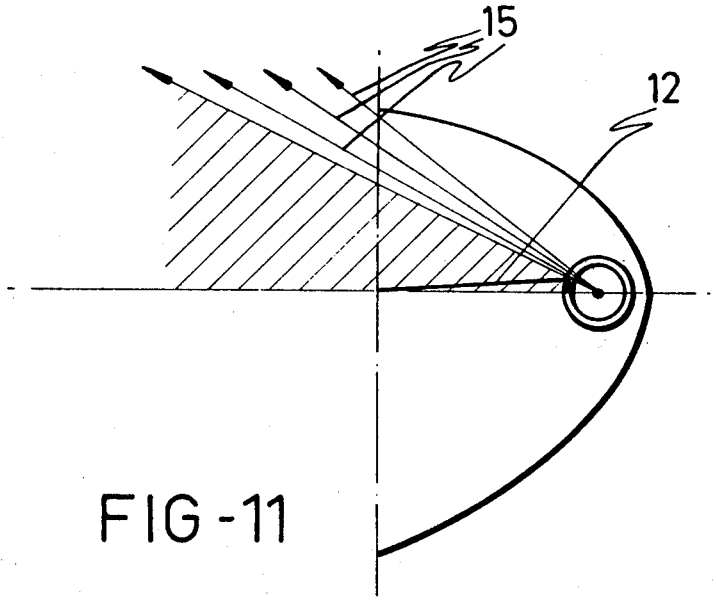
FIG. 11 is a diagram illustrating the reflector as well as the illuminating bulb, where it can be seen how rays which pass directly through the front glass of the headlamp from the bulb, which rays are not reflected in the upper reflecting zone, may illuminate possible signals or signs which can exist along the edges of the road where the vehicle travels.
Figure 12:
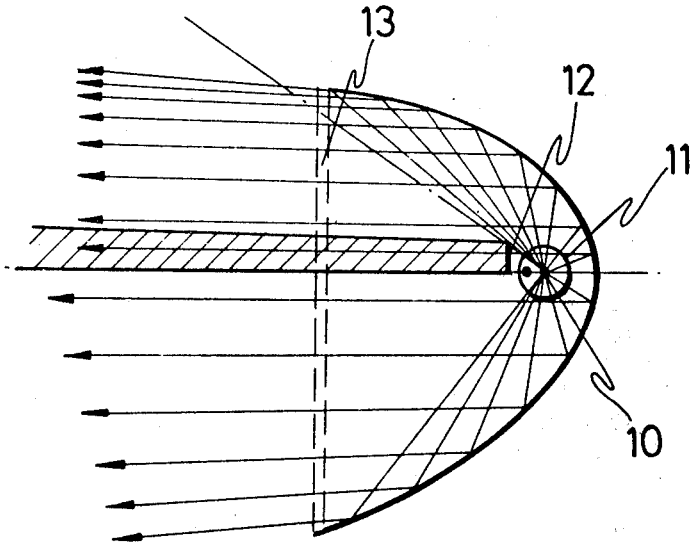
FIG. 12 is a diagram illustrating the headlamp which emits light, the illuminating zones of the upper reflector being independent of those of the lower reflector.
Figure 13:
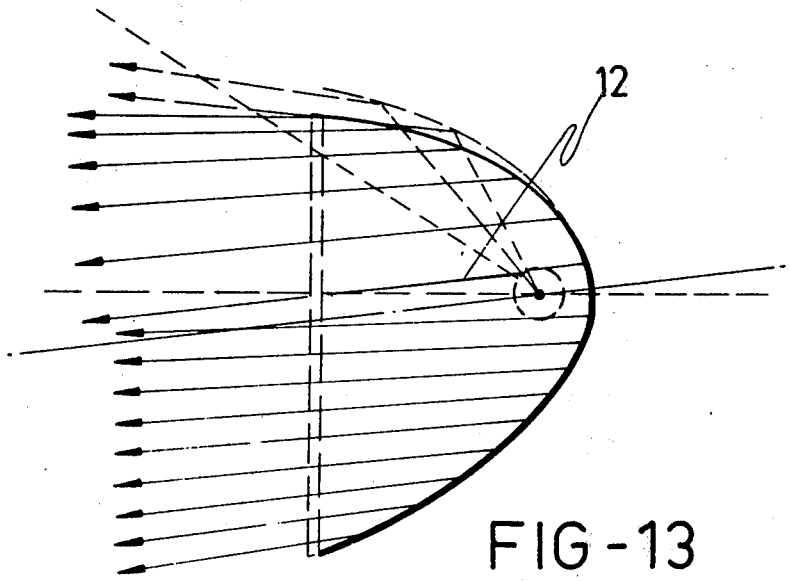
FIG. 13 is a diagram illustrating the turning of the upper reflector which prevents the luminous rays thereof from ascending.

There is a possibility that the rays 15 in FIG. 11 may be directly emitted above opaque zone 12. Such rays, which emerge from the front glass of the headlamp and have a highly inclined upwards position, permit illumination of, for example, signals or signs placed along the edge of the road. However, these rays are sufficiently separated from the horizontal plane which is established by the position of the headlamps of the vehicle, so as to prevent drivers of vehicles travelling in the opposite direction from being blinded.

Figure 10:
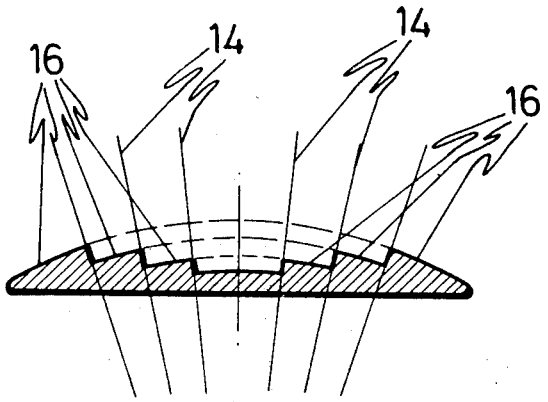
FIG. 10 is a section through the light outlet glass, which is made from cylindrical stepped segments so that the surfaces formed by such steps are not parallel and illustrating how the steps they permit the lens effect in a horizontal direction only, without modifying the vertical direction of the luminous rays.

The outlet glass, 13 of the headlamp, is essentially a converging lens whose role is that of corradiating the dispersed rays emerging from the reflector and from the filament itself, thus providing a more corradiated beam having a suitable divergence. This lens 13 has a correcting effect in a horizontal direction only, without modifying in any way whatsoever the vertical direction or component of the luminous rays. Therefore, the lens 13 is constituted, as illustrated in FIG. 10, by means of a plurality of vertically extending cylindrical segmented portions. A series of convex step form the segmented portions, in such a way that the planes 14 separating the steps follow the direction of the rays of light without hindering the rays, so that the flat narrow steps 16, are not parallel to each other. These steps 16 form specific illuminating zones independent from each other, which arrangement constitutes the basis for the manner of reducing the effect of blinding by this headlamp, together with the basic principle of controlled reflection below a horizontal plane, i.e. the plane that which is established by the height of the headlamps of the vehicle.

FIG. 6 illustrates how secondary reflection, emerging from the upper reflector, is made convergent in the proximity of the bulb and always in front of the position occupied by filament 10, since it is equivalent to a converging reflection, and how it acts as a converging output for the lower reflector, thus determining an ascending output (anti-blinding) therefrom.

It can also be seen how the direct reflection which is produced in the upper part of the outlet glass 13 acts, converging forwards of the two bulbs, thus making the lower reflector produce ascending rays.

The remaining secondary reflections do not produce, at first sight, harmful reflections, due to the converging-diverging relationship. However, since the representation made is in one plane (section) and since this reflection is three-dimensional (including side displacement), it is highly possible that such reflections may appear, producing a light atmosphere having uncontrollable effects.

For this reason it is, therefore, convenient to absorb or black such reflection from the start, placing by an opaque and absorbing flat plate 12 which will, at the same time, serve as an obstacle for the output of slightly raised direct ascending rays.

The non-reflecting zone of the sides of the upper part of the headlamp can be completely eliminated in those models which, due to their specific manufacturing shape, permit elimination of such zone.

In the construction of the headlamp, it should be borne in mind that the parabolas which form the main reflector surfaces follow, from a point determined by the intersection of the parabola with the median line of the straight line segment which joins the bulb of the parabola to the centre of the filament, a curve which approaches the tangent of the parabola at such point, but without being confused therewith. Consequently, the edges of the main reflectors tend to be flat. With this, the output divergence of the reflectors is, in the vertical component thereof, uniform.

I claim:

1. An antiblinding headlamp for vehicles, said headlamp comprising:

a straight filament arranged transversally in a horizontal position;

upper and lower reflecting surfaces each being a semi-parabola surface formed by displacing a parabola along a straight line which is tangent to the vertex of said parabola and located in a plane through the focus of said parabola, said upper and lower surfaces being joined at said straight line in a common focal plane thereof and further being cut by three planes which produce, as a projection of the upper reflecting surface on said common focal plane thereof, an isosceles trapeze;

the semi-parabolas of said upper and lower reflecting surfaces having different parabolic values;

the focal axis of said lower reflecting surface being in an advanced position with respect to the focal axis of said upper reflecting surface;

a pair of flat reflecting surfaces connecting the open lateral ends of said joined upper and lower reflecting surfaces; and a converging lens positioned at the opening formed by the juncture of said flat reflecting surfaces and said upper and lower reflecting surfaces.

2. An antiblinding headlamp for vehicles as claimed in claim 1, wherein said filament is within a cylindrical lamp and is situated along said focal axis of said upper reflecting surface; and further comprising an opaque plate having a front edge positioned in said common focal plane and a rear edge adjacent said lamp and above said focal plane.

* * * * *